US005247328A

United States Patent [19]

Daunton et al.

[11] Patent Number: 5,247,328

[45] Date of Patent: Sep. 21, 1993

[54] METHOD AND APPARATUS FOR CHARGING A PHOTOCONDUCTIVE SURFACE TO A UNIFORM POTENTIAL

[75] Inventors: Clive R. Daunton, Rochester; John J. Kopko, Macedon; Ravi Sampath, Fairport, all of N.Y.

[73] Assignee: Xerox Corporation, Stamford, Conn.

[21] Appl. No.: 945,184

[22] Filed: Sep. 15, 1992

[51] Int. Cl.[5] ..... G03G 15/02

[52] U.S. Cl. ..... 355/219; 355/221; 361/225

[58] Field of Search ..... 355/219, 221, 223, 225; 361/225

[56] References Cited

U.S. PATENT DOCUMENTS

| | | | |
|---|---|---|---|
| 3,675,011 | 7/1972 | Silverberg | 250/49.5 |
| 4,449,808 | 5/1984 | Abreu | 355/274 |
| 4,558,221 | 12/1985 | Gundlach et al. | 250/325 |
| 4,585,322 | 4/1986 | Reale | 355/325 |
| 4,603,964 | 8/1986 | Swistak | 355/225 |
| 4,638,397 | 1/1987 | Foley | 361/212 |
| 4,646,196 | 2/1987 | Reale | 361/230 |
| 4,725,731 | 2/1988 | Lang | 250/326 |
| 4,725,732 | 2/1988 | Lang et al. | 250/326 |
| 4,757,345 | 7/1988 | Ohashi et al. | 355/219 |
| 4,764,675 | 8/1988 | Levy et al. | 250/324 |
| 4,780,385 | 10/1988 | Wieloch et al. | 430/58 |
| 4,837,658 | 6/1989 | Reale | 361/230 |
| 4,841,146 | 6/1989 | Gundlach et al. | 250/324 |
| 4,949,125 | 8/1990 | Yamamoto et al. | 355/219 |
| 5,049,935 | 9/1991 | Saito et al. | 355/219 |
| 5,087,944 | 2/1992 | Yamauchi | 355/225 |
| 5,132,738 | 7/1992 | Nakamura et al. | 355/219 X |

OTHER PUBLICATIONS

Pai et al. "Double Charging Technique to Reduce Dark Decay and Cycle Down", Xerox Disclosure Journal; vol. 13, No. 1, Jan./Feb. 1988, p. 29.

VonHoene et al.; "Overcoated Photoreceptor Process Using Dicorotron Units"; Xerox Disclosure Journal; vol. 5, No. 3, May/Jun. 1980, p. 327-328.

*Primary Examiner*—A. T. Grimley
*Assistant Examiner*—Sandra L. Brase

[57] ABSTRACT

An apparatus for charging a photoconductive surface to a substantially uniform potential in a printing machine having a cleaning station for cleaning the surface and an exposure station for exposing the surface to a light source includes a first mechanism for charging the surface to a substantially uniform potential of a first polarity after the surface is cleaned at the cleaning station. The apparatus further includes a second mechanism for charging the surface to a substantially uniform potential of a second polarity opposite to the first polarity after the surface is charged to the substantially uniform potential of the first polarity by the first charging mechanism and before the surface is exposed to the light source at the exposure station. Similarly, a method of charging a photoconductive surface to a substantially uniform potential in a printing machine having a cleaning station for cleaning the surface and an exposure station for exposing the surface to a light source, includes the steps of (1) charging the surface to a substantially uniform potential of a first polarity after the surface is cleaned at the cleaning station; and (2) charging the surface to a substantially uniform potential of a second polarity opposite to the first polarity after the first polarity charging step and before the surface is exposed to the light source at the exposure station.

10 Claims, 2 Drawing Sheets

Figure 1:
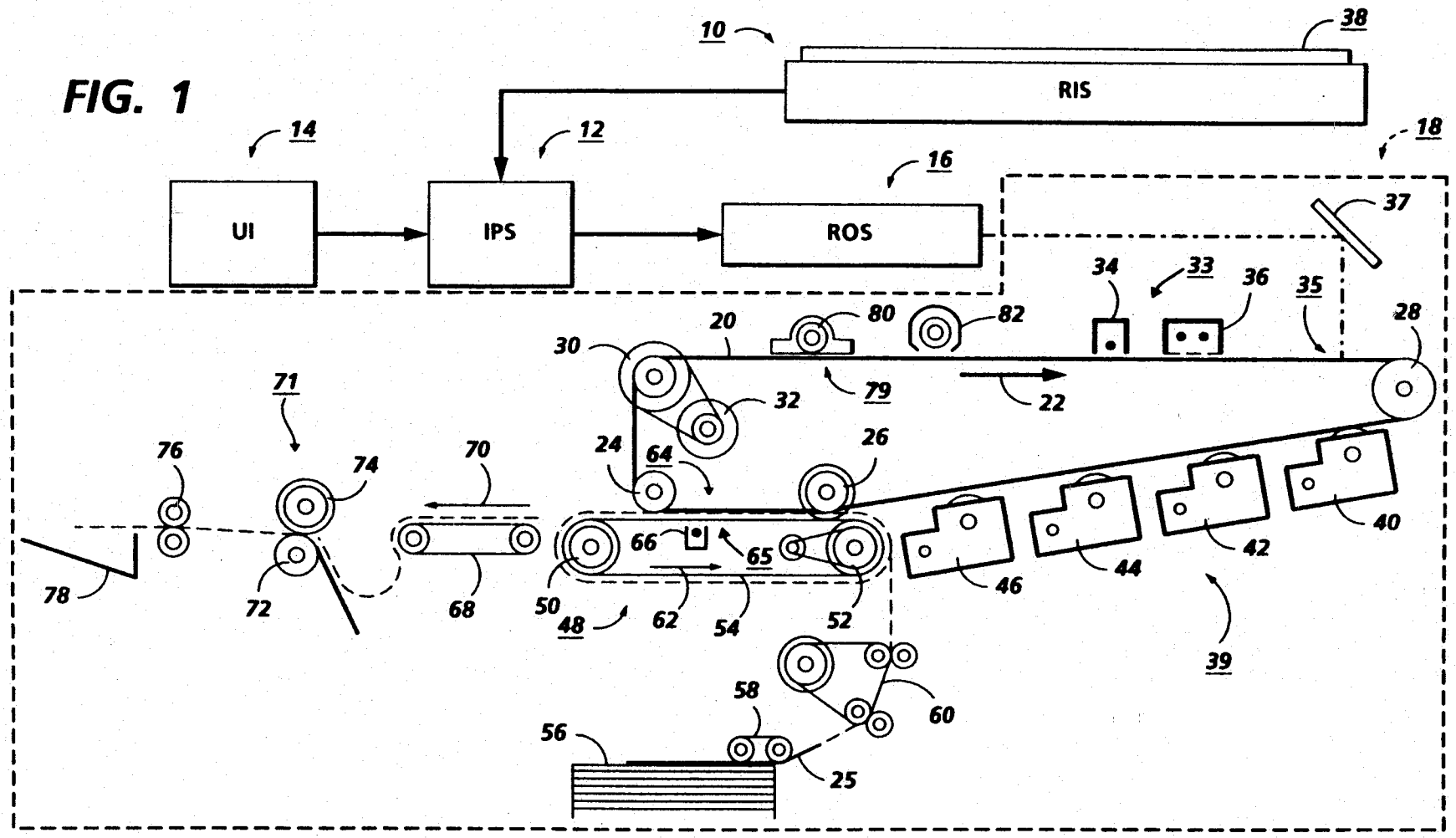

METHOD AND APPARATUS FOR CHARGING A PHOTOCONDUCTIVE SURFACE TO A UNIFORM POTENTIAL

The present invention relates generally to a method and apparatus for charging a photoconductive member to a uniform potential in a printing machine.

In a printing machine such as an electrophotographic printing machine, a cycle of steps are accomplished to create a copy of an original document on a copy sheet. In particular, a photoconductive member may be charged to a substantially uniform potential to sensitize the surface thereof. The charged portion of the photoconductive member is thereafter selectively exposed at an exposure station to a light source such as a raster output scanner. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing a developer material into contact therewith. Generally, the developer material includes toner particles adhering triboelectrically to carrier granules. The toner particles are attracted to the latent image from the carrier granules to form a toner image on the photoconductive member which is subsequently transferred to a copy sheet. The copy sheet is then heated to permanently affix the toner image thereto in image configuration. Following transfer of the toner image to the copy sheet, the photoconductive member is cleaned of the residual toner to prepare the photoconductive member for the imaging step of the next successive printing cycle.

Various types of charging devices have been used to charge the surface of a photoconductive member to a substantially uniform potential. In commercial use, for example, corona generating devices exist wherein a voltage of 4,000 to 8,000 volts may be applied across an electrode to thereby produce a corona spray which imparts electrostatic charge to the surface of the photoconductive member.

One corona generating device is a corotron and may include a single corona generating electrode wire extending between a pair of insulating end blocks mounted on either end of a channel formed by a shield or pair of shield members. Some examples of corotrons are disclosed in U.S. Pat. Nos. 4,239,373; 4,585,322; and 4,646,196; the disclosures of each of the above patents being hereby incorporated by reference. Another device which is frequently used to provide uniform charging is a scorotron. Some examples of scorotrons are disclosed in U.S. Pat. Nos. 4,638,397; 4,646,196; 4,725,731; 4,725,732; 4,764,675; and 4,841,146; the disclosures of each of the above patents being hereby incorporated by reference. A scorotron may include two or more corona wires with a control grid or screen of parallel wires or apertures in a plate which is positioned between the corona generating electrode wires and the photoconductive member. A potential having the same polarity as that applied to the corona generating electrodes but having a much smaller voltage magnitude, usually on the order of several hundred volts, is applied to the control grid which suppresses the electric field between the control grid and the corona wires and markedly reduces the ion current flow to the photoconductive member.

Certain problems may be encountered after charging the photoconductive surface with one of the prior art charging mechanisms. One such problem takes the form of the photoconductive surface possessing a nonuniform charge thereon at a point in the printing cycle after charging of the photoconductive surface with a charging mechanism and just prior to development of the latent image with toner particles. The nonuniform charge may have the characteristic that the portions of the photoconductive surface that possessed a latent image during the previous printing cycle possesses a slightly higher voltage potential (e.g. 20 volts) relative to the voltage potential of the portions of the photoconductive surface that did not possess the latent image during the previous printing cycle. The above problem may be caused by a difference in the rate at which the electrostatic charge decays on each of the above two portions of the photoconductive surface. In particular, the electrostatic charge which is located on the portions of the photoconductive surface that possessed a latent image during the previous printing cycle may decay at a slower rate than the electrostatic charge which is located on the portions of the photoconductive surface that did not possess the latent image during the previous printing cycle. The difference in voltage potential between the above two portions of the photoconductive surface at a location immediately preceding the development station may cause a printing defect during the present printing cycle. This defect may take the form of a secondary image being created on the copy sheet during the present printing cycle, wherein the secondary image is substantially in the formation of the latent image of the previous printing cycle. However, the secondary image only occurs in the areas containing the image developed on the copy sheet during the present printing cycle. The above printing defect has been referred to as "ghosting."

The following disclosures may be relevant to various aspects of the present invention:

U.S. Pat. No. 3,675,011
Patentee: Silverberg
Issued: Jul. 4, 1972

U.S. Pat. No. 4,449,808
Patentee: Abreu
Issued: May 22, 1984

U.S. Pat. No. 4,558,221
Patentee: Gundlach et al.
Issued: Dec. 10, 1985

U.S. Pat. No. 4,603,964
Patentee: Swistak
Issued: Aug. 5, 1986

U.S. Pat. No. 4,837,658
Patentee: Reale
Issued: Jun. 6, 1989

Xerox Disclosure Journal
Authors: Damodar M. Pai & Edward A. Domm
Volume 13, Number 1
January/February 1988

Xerox Disclosure Journal
Authors: Donald C. VonHoene & Richard L. Post

Volume 5, Number 3
May/June 1980

The relevant portions of the foregoing disclosures may be briefly summarized as follows:

U.S. Pat. No. 3,675,011 discloses an apparatus which includes at least two corotrons which are energized by a floating power supply exhibiting substantially constant current characteristics. The positive terminal of the floating power supply is connected to a coronode of one of the at least two corotrons while the negative terminal of the floating power supply is connected to the coronode of another one of such at least two coronodes. Additionally, the shields of each of such at least two corotrons are interconnected through a current limiting impedance so that current flow between the shields of the at least two corotrons is maintained within a selected range whereupon the ion charging current produced by each of the corotrons is maintained at substantially uniform magnitude levels.

U.S. Pat. No. 4,449,808 discloses a xerographic reproduction machine which utilizes a number of corona generating devices.

U.S. Pat. No. 4,558,221 describes a miniaturized self limiting corona generator for charging a receiver surface. The device includes a plurality of corona emitting wires housed in respective biased conductive shields with the wires being spaced farther from the receiver surface than the wire-to-shield spacing in order to provide self limiting of surface potential on the receiver surface.

U.S. Pat. No. 4,603,964 discloses an apparatus for charging a photoreceptor of a xerographic system in preparation for imaging.

U.S. Pat. No. 4,837,658 describes a corona charging device for depositing negative charge on an imaging surface. The device includes at least one elongated conductive metal corona discharge electrode supported between insulating end blocks and being coated with a substantially continuous thin conductive dry film of aluminum hydroxide containing conductive particles. The corona discharge electrode may be a thin metal wire or alternatively at least one linear array of pin electrodes and the conductive particles in the coating are graphite particles.

The Xerox Disclosure Journal authored by Pai et al. discloses a double charging technique to reduce dark decay and cycle down. According to the disclosure, after a photoreceptor has been charged, a second charging step, having the same polarity as the first charging step, may be provided just prior to the exposure step. The second charging step may be implemented by providing two spaced corotrons operating at the same polarity. The arrangement has the functional appearance of a wide scorotron charging device in a similar position.

The Xerox Disclosure Journal authored by VonHoene et al. discloses an overcoated photoreceptor process using dicorotron units.

In accordance with one aspect of the present invention, there is provided an apparatus for charging a photoconductive surface to a substantially uniform potential in a printing machine having a cleaning station for cleaning the surface and an exposure station for exposing the surface to a light source. The apparatus includes a first mechanism for charging the surface to a substantially uniform potential of a first polarity after the surface is cleaned at the cleaning station. The apparatus further includes a second mechanism for charging the surface to a substantially uniform potential of a second polarity opposite to the first polarity after the surface is charged to the substantially uniform potential of the first polarity by the first charging mechanism and before the surface is exposed to the light source at the exposure station.

Pursuant to another aspect of the present invention, there is provided a method of charging a photoconductive surface to a substantially uniform potential in a printing machine having a cleaning station for cleaning the surface and an exposure station for exposing the surface to a light source. The method includes the steps of (1) charging the surface to a substantially uniform potential of a first polarity after the surface is cleaned at the cleaning station; and (2) charging the surface to a substantially uniform potential of a second polarity opposite to the first polarity after the first polarity charging step and before the surface is exposed to the light source at the exposure station.

Figure 2:
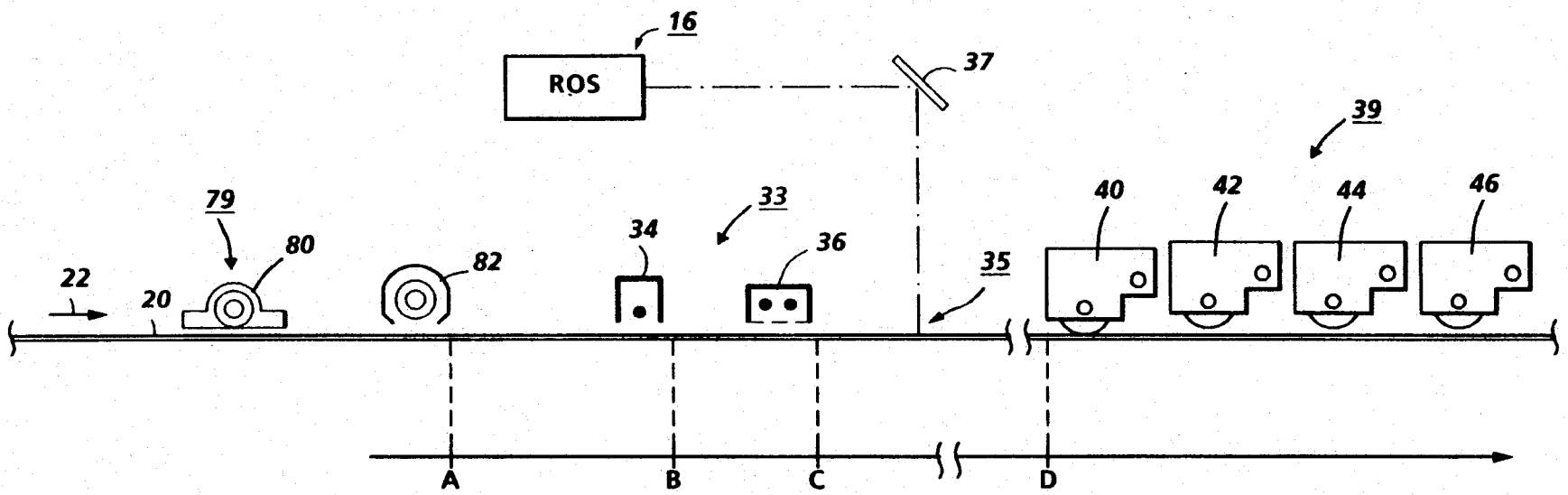

Other features of the present invention will become apparent as the following description proceeds and upon reference to the drawings, in which:

FIG. 1 is a schematic elevational view showing an electrophotographic printing machine incorporating the features of the present invention therein; and FIG. 2 is a schematic elevational view showing the cleaning station, the charging station, the exposure station and the development station used in the electrophotographic printing machine of FIG. 1.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein. For example, the invention would be well suited for use in a printer which prints on consecutive sheets, each sheet containing information which differs from the previously printed sheet (e.g. a pamphlet having multiple pages, each page containing information which differs from the information contained on the previous page).

Turning now to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from the original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt or member 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably a multi-layered photoconductive imaging belt. Suitable multi-layered photoconductive imaging belts are disclosed in both U.S. Pat. No. 4,265,990 issued to Stolka et al. and U.S. Pat. No. 4,780,385 issued to Wieloch et al., the disclosure of each of the above patents being hereby incorporated by reference. The photoconductive belt moves in the direction of arrow 22 to advance successive portions of the surface of the photoconductive belt sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corotron 34 charges the surface of the photoconductive belt to a substantially uniform positive potential which is preferably greater than 100 volts and less than 300 volts. With continued advancement of the photoconductive belt 20, the surface of the photoconductive belt then comes under the influence of a scorotron 36 so as to charge the surface of the photoconductive belt to a substantially uniform negative potential which is preferably greater than −1100 volts and less than −600 V volts.

Next, the charged photoconductive surface is advanced to an exposure station, indicated generally by the reference numeral 35. Exposure station 35 receives a modulated light beam corresponding to information derived by RIS 10 having multi-colored original document 38 positioned thereat. The modulated light beam impinges on the surface of photoconductive belt 20. The beam selectively illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the surface of the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the non-operative position, the magnetic brush is spaced therefrom. In FIG. 1, developer unit 40 is shown in the operative position with developer units 42, 44 and 46 being shown in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with the photoconductive belt 20. The sheet transport apparatus 48 may be similar to the sheet transport apparatus disclosed in U.S. Pat. No. 5,075,734 issued to Durland et al., the disclosure of which is hereby incorporated by reference. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a corona generating device 66, such as a corotron, sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multi-color copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates the photoconductive belt 20 in an attempt to remove any residual charge remaining thereon prior to the start of the next successive cycle.

FIG. 2 depicts the advancement of a portion of the photoconductive member 20 in the direction of arrow 22 from a location A to a location D. At location A, the portion of the photoconductive member 20 has just passed by the lamp 82 so as to illuminate the surface of the photoconductive member as stated above. As a result, substantially all of the electrostatic potential on the surface of the portion of the photoconductive member has been removed (i.e. possesses a voltage potential of zero volts). However, the areas of the photoconductive member, at location A, on which the latent image of the previous printing cycle was positioned may possess different electrical characteristics (e.g. the rate at which electrostatic charge positioned thereon decays) relative to the electrical characteristics of the areas of the photoconductive member that did not possess a latent image during the previous printing cycle.

With further advancement of the portion of the photoconductive belt 20 from location A to a location B, the corotron 34 charges the portion of the photoconductive member to a substantially uniform positive potential which is preferably greater than 100 volts and less than 300 volts. As the portion of the photoconductive member 20 is further advanced from location B to a location C, the portion of the photoconductive belt comes under the influence of the scorotron 36 so as to charge the portion of the photoconductive belt to a substantially uniform negative potential which is preferably greater than −1100 volts and less than −600 volts. In order to achieve charging of the photoconductive member 20 as stated above, the corona generating electrode wire of the corotron 34 may be electrically coupled to an AC voltage source of 2.50 kV, at 440 Hz, with a DC voltage offset of 2.50 kV. In addition, the corona generating electrodes of the scrotron 36 may be electrically coupled to a DC voltage source of −5.00 kV, while control grid of the scorotron 36 may be electrically coupled to a DC voltage source of −850 volts.

At location C, the areas of the photoconductive surface on which the latent image of the previous printing cycle was positioned may now possess substantially similar electrical characteristics (e.g. the rate at which electrostatic charge positioned thereon decays) relative to the areas of the photoconductive surface that did not possess a latent image during the previous printing cycle. With the surface of the photoconductive member possessing a substantially uniform negative potential thereon at location C, the portion of the photoconductive member is then advanced through the exposure station to form an electrostatic latent image on the photoconductive member, as discussed above. With further advancement of the portion of the photoconductive member 20 from the location C to the location D, such portion is positioned at a location just prior to passing through the development station 39. At this location, the latent image positioned on the photoconductive member 20 has a substantially uniform electrostatic voltage potential, irrespective of what had occured during the previous printing cycle. The portion of the photoconductive member 20 is then advanced through the development station 39 to develop the latent image on the photoconductive member 20, as discussed above.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and scope of the appended claims.

We claim:

1. An apparatus for charging a photoconductive surface to a substantially uniform potential in a printing machine having a cleaning station for cleaning the surface and an exposure station for exposing the surface to a light source, comprising:

first means for charging the surface to a substantially uniform potential of a first polarity after the surface is cleaned at the cleaning station; and second means for charging the surface to a substantially uniform potential of a second polarity opposite to the first polarity after the surface is charged to the substantially uniform potential of the first polarity by the first charging means and before the surface is exposed to the light source at the exposure station.

2. The apparatus of claim 1, wherein the first polarity is positive and the second polarity is negative.

3. The apparatus of claim 2, wherein the first charging means charges the surface to a substantially uniform positive potential of greater than 100 V and less than 300 V.

4. The apparatus of claim 3, wherein the second charging means charges the surface to a substantially uniform negative potential of greater than −1100 V and less than −600 V.

5. The apparatus of claim 2, wherein the first charging means comprises a corotron positioned substantially adjacent the photoconductive surface.

6. The apparatus of claim 5, wherein the second charging means comprises a scorotron positioned substantially adjacent the photoconductive surface.

7. A method of charging a photoconductive surface to a substantially uniform potential in a printing machine having a cleaning station for cleaning the surface and an exposure station for exposing the surface to a light source, including the steps of:

charging the surface to a substantially uniform potential of a first polarity after the surface is cleaned at the cleaning station; and charging the surface to a substantially uniform potential of a second polarity opposite to the first polarity after the first polarity charging step and before the surface is exposed to the light source at the exposure station.

8. The method of claim 7, wherein:

the first polarity charging step includes the step of charging the surface to a substantially uniform positive potential; and the second polarity charging step includes the step of charging the surface to a substantially uniform negative potential.

9. The method of claim 8, wherein the positive charging step includes the step of charging the surface to a substantially uniform positive potential of greater than about 100 V and less than about 300 V.

10. The method of claim 9, wherein the negative charging step includes the step of charging the surface to a substantially uniform negative potential of greater than about −1100 V and less than about −600 V.

* * * * *